US010085913B2

(12) United States Patent
Blenk et al.

(10) Patent No.: US 10,085,913 B2
(45) Date of Patent: Oct. 2, 2018

(54) MASSAGE DEVICE

(71) Applicants: Udo Blenk, Berlin (DE); Stefan Stoehr, Berlin (DE)

(72) Inventors: Udo Blenk, Berlin (DE); Stefan Stoehr, Berlin (DE)

( * ) Notice: Subject to any disclaimer, the term of this patent is extended or adjusted under 35 U.S.C. 154(b) by 669 days.

(21) Appl. No.: 14/420,348

(22) PCT Filed: Aug. 5, 2013

(86) PCT No.: PCT/DE2013/000433
§ 371 (c)(1),
(2) Date: Jun. 15, 2015

(87) PCT Pub. No.: WO2014/023280
PCT Pub. Date: Feb. 13, 2014

(65) Prior Publication Data

US 2015/0305972 A1 Oct. 29, 2015

(30) Foreign Application Priority Data

Aug. 7, 2012 (DE) ..... 10 2012 015 471

(51) Int. Cl.
*A63B 24/00* (2006.01)
*A61H 19/00* (2006.01)
(Continued)

(52) U.S. Cl.
CPC ..... *A61H 19/44* (2013.01); *A61H 15/0085* (2013.01); *A61H 19/34* (2013.01);
(Continued)

(58) Field of Classification Search
CPC .... A61H 19/44; A61H 19/34; A61H 23/0218; A61H 2023/002; A61H 15/0085; B06B 1/045
See application file for complete search history.

(56) References Cited

U.S. PATENT DOCUMENTS 2,943,621 A 7/1960 Phillips
3,991,751 A 11/1976 O'Rourke
(Continued)

FOREIGN PATENT DOCUMENTS

CN 85205738 12/1986
CN 2166809 6/1994
(Continued)

OTHER PUBLICATIONS https://en.wikipedia.org/wiki/paperboard cited Jun. 23, 2017, 5 pages.

*Primary Examiner* — Glenn Richman
(74) *Attorney, Agent, or Firm* — Karin L. Williams; Mayer & Williams PC

(57) ABSTRACT

The massaging device includes electromechanical means, for generating mechanical vibrations, in a housing, electronic means for controlling the electromechanical means, and a power source connected to the electromechanical and electronic means. The electromechanical means includes a cylinder element, in which a core is guided in parallel to a cylinder element axis (Z2), in particular, coaxial with respect to the cylinder element axis (Z2), at least one coil element, the coil axis (Z3) of which is arranged coaxially with respect to the cylinder element, and which encloses the cylinder element, and one impact element arranged at each end of the cylinder element and in the interior thereof, characterized in that the impact elements are formed as end magnets, wherein the ends of the end magnets respectively facing the ends of the core have a magnetic polarity which is identical to the polarity of the respectively facing ends of the core.

21 Claims, 3 Drawing Sheets

(51) Int. Cl.

| | |
|---|---|
| ***A61H 23/02*** | (2006.01) |
| ***B06B 1/04*** | (2006.01) |
| ***A61H 15/00*** | (2006.01) |
| *A61H 23/00* | (2006.01) |

(52) U.S. Cl.
CPC ..... *A61H 23/0218* (2013.01); *B06B 1/045* (2013.01); *A61H 2023/002* (2013.01)

(56) References Cited

U.S. PATENT DOCUMENTS

| | | | |
|---|---|---|---|
| 4,377,692 | A | 3/1983 | Barry et al. |
| 4,697,581 | A | 10/1987 | Endo et al. |
| 5,434,549 | A | 7/1995 | Yasuyuki |
| 9,192,542 | B2 | 11/2015 | Blenk |
| 2002/0156402 | A1 | 10/2002 | Woog et al. |
| 2008/0001484 | A1† | 1/2008 | Fuller |
| 2011/0144426 | A1 | 6/2011 | Blenk |
| 2012/0172661 | A1 | 7/2012 | Chiu |
| 2013/0197302 | A1 | 8/2013 | Levy |
| 2014/0243589 | A1 | 8/2014 | Rowan |

FOREIGN PATENT DOCUMENTS

| | | | |
|---|---|---|---|
| CN | 2375027 | | 4/2009 |
| DE | 2310862 | | 9/1974 |
| DE | 2437053 | A1 | 2/1976 |
| DE | 19615557 | A1 | 10/1997 |
| DE | 29913641 | | 3/2000 |
| DE | 102005042092 | | 10/2007 |
| DE | 10 2008 016959 | A1 | 11/2009 |
| FR | 2887144 | | 12/2006 |
| JP | H11168869 | | 6/1999 |
| JP | 2005-348815 | | 12/2005 |
| WO | 00/23030 | | 4/2000 |
| WO | 2005/041845 | | 5/2005 |
| WO | 2009/152813 | | 12/2009 |

† cited by third party

MASSAGE DEVICE

FIELD OF THE INVENTION

The invention relates to a massaging device, particularly for sexual stimulation, comprising electromechanical means for generating mechanical vibrations disposed in the housing, electronic means for controlling the means for generating mechanical vibrations disposed in the housing, and a power source, which is connected to the means for generating mechanical vibrations and to the electronic means, the means for generating mechanical vibrations including at least one coil element and at least one ferromagnetic core arranged parallelly or coaxially with respect to the coil element and displaceably guided parallelly to a cylinder axis of the housing. Furthermore, the invention relates to the use of such a massaging device for sexual stimulation.

PRIOR ART AND BACKGROUND OF THE INVENTION

Massaging devices for sexual stimulation are known in the art from the documents U.S. Pat. No. 3,991,751 and U.S. Pat. No. 4,377,692. These are mainly devices in a shape and appearance simulating a male member, which have incorporated therein means for generating mechanical vibrations. In the massaging devices known so far, the means for generating mechanical vibrations typically include an electric motor, on the shaft of which a vibration element having an unbalance is mounted. Thereby, upon rotation of the electric motor, a vibration is generated, which extends generally orthogonally to the longitudinal extension of the housing, since the axis of the electric motor is arranged parallelly to the housing axis. In the massaging devices known insofar, vibrations of relatively high frequency and low stroke are generated. In addition, disturbing noises with the frequency of the vibrations will in most cases be caused. All this is disadvantageous for the application of the massaging device, as this is perceived as rather disturbing.

The massaging devices of the type mentioned above are for example known in the art from the documents DE 29913641 U1, DE 2310862 A, and DE 19615557 A1. In the first document above, the means for generating mechanical vibrations are loudspeaker elements, the loudspeaker axis of which is arranged parallelly or coaxially with respect to the cylinder axis of the housing. Due to the use of loudspeakers, the generated vibrations have a relatively high frequency with a minimum stroke in the direction of the cylinder axis. In the subject matter of DE 19615557, only a front end of the housing is vibrated and not the whole body. Consequently, the massage effect is rather low. In the subject matter of the document DE 2310862, the direction of the vibrations remains unclear.

In massaging devices for the purposes mentioned above, it is generally desirable that on the one hand, the massaging device itself as a whole performs vibrations, that on the other hand, these vibrations have a relatively high amplitude, and finally that the vibrations occur in directions parallelly to the housing axis of the cylindrical housing, as this will have a significantly improved massage effect. In addition, it is desirable that such a massaging device can be operated very quietly, preferably practically noiselessly.

A massaging device, which solves the above problems in an essentially excellent manner, is known from the document WO 2009/152813 A1. In the insofar known massaging device, details are however improvable, particularly with respect to the impact elements, which limit or dampen the movements of the core in the areas of motion reversal. I.e. the used springs and/or foam materials or the like may, on one hand, "break down" at very high vibration amplitudes of the core, with the result that impacts and related noise are noticeable, both of which are uncomfortable. In addition, particular foam materials used as impact elements wear over time and lose their cushioning effect, again with the consequence of increasingly noticeable impacts and audible noise. Finally, energy consumption and overall length can further be optimized.

Technical Problem of the Invention

The invention is therefore based on the technical problem to provide a massaging device which as a whole carries out vibrations having comparatively high amplitude in directions parallel to the longitudinal housing axis, and that with a low frequency, improved comfort even at high amplitudes, as well as improved noise behavior and improved massage effect. Furthermore, it is the technical object to further optimize energy consumption and overall length.

PRINCIPLES OF THE INVENTION AND PREFERRED EMBODIMENTS

Figure 1:
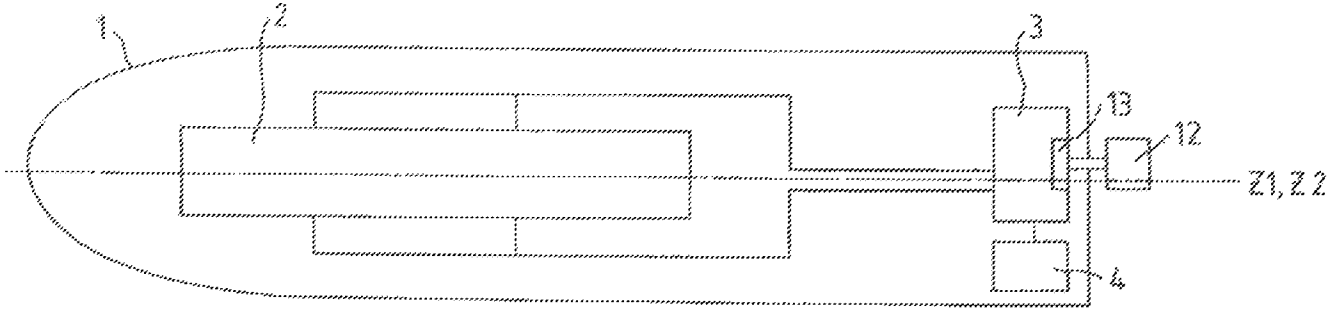
FIG. 1: an external view of a massaging device according to the invention, partially cut open.

To solve this technical problem, the invention teaches that the impact elements are formed as end magnets, wherein the ends of the end magnets respectively facing the ends of the core have a magnetic polarity, which is identical to the polarity of the respectively facing ends of the core.

The direction of magnetization of both the core and the end magnets is parallel, in particular coaxial with respect to the (longitudinal) housing axis, so that the magnets have at each of their ends, as seen in the direction of the (longitudinal) housing axis, a north and a south pole each. The end magnets can be configured as permanent magnets as well as electric magnets.

By the invention, it is achieved, on one hand, that the massaging device performs particularly soft and in particular impact-free reciprocating movements, because the end magnets very softly and progressively dampen any kinetic excess energy of the core in the area of the motion reversal points. Further, disturbing noises by hitting the core on the ends of the cylinder element can also reliably be prevented. Furthermore, the invention allows decreasing the overall length of the cylinder element while maintaining the massaging effect. Further, the energy consumption of the massaging device is reduced while maintaining the massaging effect, since the impact elements configured according to the invention operate with virtually no loss, i.e. will particularly effectively "spring back", unlike, for example, foam impact elements, in which a significant portion of the kinetic energy of the core is lost during "spring-back". Finally, the end magnets used according to the invention operate virtually wear-free, so that all the above benefits are maintained over the entire life of the massaging device.

In particular, there are most various possibilities of further improvements.

Thus, it is advantageous if the magnetic field strengths of the core and of the end magnets are selected and arranged with respect to each other with the proviso that with vertical arrangement and without exposure to artificial external magnetic fields, there remains, with an additional application of a load on the core with 2 to 30 times, preferably 4 up to 24 times, in particular 6 to 18 times its own weight, still an air gap or a minimum distance between core and end magnet. The minimum distance should be at least 0.1 mm.

The end magnets can be secured to the cylinder element by means of end pieces. The end pieces can also enclose or envelop the end magnets. In the latter case, the above-mentioned air gap or minimum distance, respectively, remains not between core and end magnet, but between core and end piece or envelope.

A certain portion of the energy required for the operation of the massaging device is lost in a closed (in the sense of outwardly gas-tight) cylinder element by that air spaces between the core and the end magnets are constantly compressed and expanded. Herein, the concept of air spaces is referred to any gas spaces between the outer wall of the core, on the one hand, and the inner walls of the cylinder element and the end pieces or end magnets, respectively, on the other hand. However, other gas fillings than air are contemplated. Further, the gas pressure may differ from the ambient air pressure, may particularly be lower ("vacuum" in the sense of less than 0.5, more preferably less than 0.2 of the ambient air pressure). Therefore, it is advantageous if these air spaces either communicate with each other or are connected with the air space outside the cylinder element and/or the housing. This can be done in a variety of ways, which can also be combined with each other. Thus, it is possible that the connection of the air spaces between the core and the end magnets is provided by means of at least one longitudinal bore through the core, at least one external core groove extending over the total length of the core, and/or at least one cylinder groove extending on the inner side of the cylinder element at least over the entire range of movement of the core. Moreover, the connection of the two air spaces can also take place over a distance between core and cylinder element, which is sufficiently large for an exchange of air. In this variant, it is recommended that a gap value (when the core is held in the center of the cylinder element) between core and cylinder element of more than 0.1 mm, preferably more than 0.2 mm, in particular more than 0.5 mm is provided. However, the connection of the air spaces between the core and the end magnets may also be formed by means of a tube arranged outside the cylinder element, the two ends of the tube being connected with openings in the cylinder element, which in the region of a respective end magnet lead into the air spaces between core and magnets. In place of such a tube, an outer housing or a cavity correspondingly extending therein can also be provided. In other words, the two air spaces on both sides of the ends of the core pneumatically communicate with each other. In the simplest case, outwardly open openings are provided in the cylinder element, which in the region of a respective end magnet lead into the air spaces between the core (6) and the magnets. It is also possible that these openings are connected by tubes, which lead at the outer surface of the massaging device to at least one outlet opening, and the design and layout of the outlet opening can be chosen so that by the resulting air currents an additional stimulation and massage is effected.

The cylinder element limits the radial movement possibility of the core. Thus, it is undesirable when openings in the cylinder element are arranged in the movement region of the core. If there were such openings, they would temporarily be covered and sealed to some extent by the core, what is disturbing. Therefore, openings in the front face of the cylinder element are advantageous, preferably in the end magnets, in particular in the end pieces. These openings in the end pieces may be configured such that the end magnets do not occupy the entire end face of the interior of the cylinder element. In the simplest embodiment, the end magnets are formed with a smaller outer diameter than the inner diameter of the cylinder element. In the part of the end piece thus remaining free then one or more openings may be arranged. In case of multiple openings they will then be arranged along a circle extending between the outer periphery of the end magnet and the inner diameter of the cylinder element. In particular the latter embodiment with, for example, 2 to 20 openings distributed along the circle, reliably avoids annoying whistle sounds.

It is advantageous, if the cylinder element is formed of a metallic material with a permeability of less than 1, in particular aluminum. The advantage over organic polymer materials is that metal tubes can be manufactured comparatively very precisely, even in the internal dimensions, in particular tubes of circular internal cross section have only minimum deviations from the circular shape of the cross section, while plastic tubes often have a considerable ovality. The latter is disturbing, for example, since thereby an undesirable play between the cylinder element and the core is created, with the result that rattling noises may occur. This is achieved, for cylinder elements made of metallic materials, not only purely geometrically by high precision and thus improved fit between the core and the cylinder element, but also dynamically due to the inductance (Lenz's law) in the wall of the cylinder element, which by means of the resulting magnetic fields causes a radial guidance of the core and reliably prevents lateral hitting the core on the inner wall of the cylinder element.

With respect to cross section, the inner wall of the cylinder element and the outer wall of the core may in principle have any cross-sectional shapes. If for technical reasons a possible rotation of the core about its longitudinal axis is to be inhibited, a non-circular cross section is recommended, such as square, polygonal or also circular with a guide groove extending in the direction of the longitudinal extension and a guide projection engaging therein, wherein the groove may be located in either the cylinder element or in the core. For the sake of a simple and inexpensive manufacture, however, it is preferred that the inner wall of the cylinder element is circular in cross section orthogonally to the cylinder element axis Z2, and that the core has a cylindrical shape preferably with a radius which is by 0.01 to 1.5 mm, in particular by 0.01 to 0.5 mm, smaller than the cross-sectional inner radius of the cylinder element. When cylinder elements from metallic materials having a permeability of less than 1 are used, the radius of the core may also be by more than 0.5 mm smaller than the cross section of the cylinder element. Then, too, disturbing noises (rattling) are nearly excluded.

The core may be formed by a single bar magnet, but also by several bar magnets (e.g., having a comparatively short length) magnetically arranged in series. In the latter case, it is possible to fix the several bar magnets (in addition to the magnetic connection) by means of an applied or shrunk-on plastic sheath mechanically relative to each other and to connect them to each other.

For the core and/or the end magnets, all commercially available (identical or different) magnetic materials can be used. Particularly inexpensive in manufacture is the use of normal ferrite material, for example based on iron or based on barium or strontium. Smaller dimensions or stronger drive forces are, of course, possible with high-power magnetic materials such as cobalt-samarium, neodymium-iron-boron.

It is preferred if the mass ratio m1:m2 between the core mass m1 and the device mass m2 is in the range from 1:50 to 1:3, in particular from 1:20 to 1:3 or 1:10 to 1:3 or 1:5. In these contexts, it is advantageous if the mass m1 is in the range from 10 to 300 g, preferably from 15 to 200 g, in particular from 10 to 100 g. In the present invention, it is preferred when the stroke of the core in directions parallel to the cylinder axis is in the range from 5 to 150 mm, preferably from 10 to 100 mm, in particular from 10 to 60 mm.

In the context of the invention, it is further preferred if the electronic means control the means for generating mechanical vibrations at a frequency in the range from 0.1 to 50 Hz, preferably from 0.1 to 20 Hz, most preferably from 0.3 to 10 Hz, in particular from 0.3 to 5 or 10 Hz.

The electronic means can control the means for generating mechanical vibrations so that the massaging device oscillates in the range of harmonic as well as non-harmonic vibrations. Particularly advantageous is the control of the means for generating mechanical vibrations by application of electrical energy having a pulse duration (within one period) in the range from 5 to 100 ms, preferably from 10 to 60 ms, in particular from 20 to 40 ms, to the coil elements. These values relate to a rectangular shape of the pulses. Otherwise, the triangular, sinusoidal, trapezoidal, or polynomial are contemplated, also combinations of said pulse shapes. Preferred are pulse shapes with steep flanks, such as for example rectangular or trapezoidal shapes.

A change of the period and thus of the frequency can take place by varying the intervals between two pulses—with otherwise unchanged pulse duration. Basically, the control means will be configured for varying the frequency and the duty cycle, the variation of the duty cycle at a predetermined frequency leading to the above variation of the pulse duration.

Further, it is preferred, if the electronic means control the means for generating mechanical vibrations in a way that not only uniform vibrations, for example sinusoidal (harmonic) vibrations, can be generated, but also vibrations with significantly non-harmonic character. This has the advantage that the massage effect is improved. For this purpose, the switching intervals between the above-described pulses (in a speed unit adjusted by the user) can vary in successive periods and/or within a period by up to 10 to 800 ms, preferably 15 to 600 ms, in particular 20 to 40 ms, relative to each other (with unchanged pulse duration). Independently thereof, the switching pauses of a stage (oscillation) amongst each other can differ by 2 to 100 times, preferably 3 to 80 times, in particular by 4 to 60 times.

For all parameters discussed above, the lower and/or upper limits of different ranges of the same parameter can however also be combined with each other in an arbitrary manner.

The housing can in principle have any usual form for massaging devices. In one variant, the housing comprises at least one substantially cylindrical housing part, but it may however also have an overall substantially cylindrical shape. The cylinder element axis is then substantially parallel or coaxial with respect to the cylinder axis of the housing or the cylindrical housing part.

In a preferred embodiment, two mutually coaxial excitation coils spaced apart in the direction of the cylinder element axis are arranged. These are alternately energized so that the core is attracted from the respective end position of the stroke in the opposite direction. In the case of a magnetized core, the two coils are controlled with a polarity opposite to that of the core. It is however also possible, with an appropriate control mechanism, to work with only one excitation coil and/or attract and/or repel the magnetized core by the excitation coil(s).

Suitably, the housing has an outer wall formed of a physiologically acceptable material. For this purpose, in principle, all the usual medical polymer materials are contemplated, including, in particular, silicone plastics, latex, polyolefins, and the like.

It is useful if an inner wall of the cylinder element and/or an outer wall of the core have a lubricious coating. In this way, the static and kinetic friction between the core and the inner wall of the cylinder element are reduced so that the energy consumption of the coils is reduced. For this, in principle all lubricious coatings customary in the filed of mechanics are contemplated, expediently coefficients of static friction of <0.2 being provided between the mutually sliding surfaces. Only examples of such a lubricious coatings are polyolefins and fluorinated hydrocarbons, in particular PTFE. Alternatively, it is of course also possible to guide the core in the cylinder element by means of linear roller bearings or the like. Instead of a lubricious coating, or in addition thereto, conventional lubricants, liquid or pasty, can also be used. These include in particular oils and fats based on hydrocarbon or silicone.

The energy source is configured appropriately as a replaceable battery or accumulator. In the latter case, it is recommended that the electronic means additionally comprise a charging circuit for the battery, causing that the battery of the massaging device can be recharged after use by a conventional power supply. To this end, then, the housing has an electrical plug connection for connecting the charger. As an alternative to a plug connection, means may be provided for wireless charging, for example, an induction loop integrated in the massaging device. Then, for charging, the massaging device is inserted into a charging station, which in turn comprises inductive means for feeding electrical energy. Alternatively, the electrical energy can be transmitted through magnetic plugs. Compared to conventional plug connections, in which the transfer takes place by mechanical spring contacts, magnetic plugs establish the contact for the transmission of electrical energy by magnetic attraction between two magnets (or two pairs of magnets). The correct electrical polarity of the DC power supply of both terminals of a plug connection is made possible by the corresponding magnetic polarity of the terminals, i.e. the two magnet pairs of a contact pair have opposite magnetic polarity.

Further, it is preferred that the electronic means are connected to at least one control unit, by means of which the frequency and/or stroke of the mechanical vibrations of the core are adjustable and controllable in steps or continuously. These control units can be arranged in or on the massaging device or in the region of one end of the housing or a front face of the housing and be adapted for manual operation. In the simplest case, this is achieved by one or more rotary buttons, for example potentiometers, but plus/minus buttons and the like are also possible, particularly in connection with a processor-controlled electronic control system. Alternatively, it is also possible that the control units are arranged at a distance from the housing and are connected by wires or wirelessly to the electronic means. In the latter case, a receiver is then integrated in the housing, which is configured for communication with a separate transmitter, the transmitter then including the manually operable control unit. Alternatively or additionally, the control of the electronic means can take place by acoustic signals (by means of a corresponding control component). In this case, the acoustic signals may comprise or include all kinds of audible sound, in particular in the range from 50 Hz to 10,000 Hz, in particular, may be formed by human speech. The control via speech occurs by means of words, such as "faster/slower," "more/less" or "harder/softer". The control via sound occurs by means of the intensity, rhythm, frequency components and/or the timing of the acoustic signals, which are, for instance, music, pulse beat, and human utterances, in particular groaning. The intensity of the acoustic signals relates to the frequency and/or modification of specific frequencies (treble and bass) of the sound.

The term of the substantially cylindrical housing or cylinder element is not limited to the exact cylindrical shape. Rather, the cross section may differ from the circular shape. Furthermore, the respective cylinder axis may extend nonlinearly. Finally, at least one cylinder front face of the housing is preferably not flat, but rounded, in particular, for example, simulating the front end of a male member. The outer surface of the housing may be not only smooth, but may also have a topography, such as regularly or irregularly spaced ribs.

A massaging device according to the invention can be used for any conventional massage purposes of various candidate body parts, such as shoulder/neck area, but also for the sexual stimulation in particular of a woman. In either case, the massaging device is contacted with the body part in question and is previously or subsequently turned on.

The invention however also relates to a device for generating vibrations on an object, in particular a stroller, a crib or other lying surface for a person, comprising electromechanical means for generating mechanical vibrations disposed in a housing, comprising electronic means for controlling the means for generating mechanical vibrations disposed in the housing, and comprising an energy source, which is connected to the means for generating mechanical vibrations as well as to the electronic means, the means for generating mechanical vibrations including a cylinder element, in which a core is guided parallelly to a cylinder element axis (Z2), in particular coaxially with respect to the cylinder element axis (Z2), at least one coil element, the coil axis (Z3) of which is arranged coaxially with respect to the cylinder element, and which encloses the cylinder element, and one impact element each, which is arranged at each end of the cylinder element and in the interior thereof, and the device being securable to the object by means of at least one fastening element. This variant is characterized in that the impact elements are configured as end magnets, the ends of the end magnets respectively facing the ends of the core having a magnetic polarity, which is identical to the polarity of the respective facing ends of the core. Then it will be recommended that the electronic means control the means for generating mechanical vibrations with a comparatively rather low frequency, for example a frequency from 0.1 to 20 Hz, preferably from 0.3 to 10 Hz, in particular from 0.3 to 5, or to 10 Hz. Apart from that, all of the above and the below explanations with regard to the variant as a massaging device apply in an analogous manner. In particular, all above and below terms and all terms used in the claims referring to "massaging device" can be replaced in a corresponding manner by "device for generating vibrations on an object".

In the following, the invention is explained in detail with reference to figures representing an example of execution only.

In FIG. 1 can be seen that the massaging device has a substantially cylindrical housing 1. In the housing 1 are arranged electromechanical means 2 for generating mechanical vibrations. In addition, the housing contains electronic means 3 for controlling the means 2 for generating mechanical vibrations. Finally, an energy source 4 is provided in the housing 1, which energy source is connected to the means 2 for generating mechanical vibrations as well as to the electronic means 3.

Figure 2:
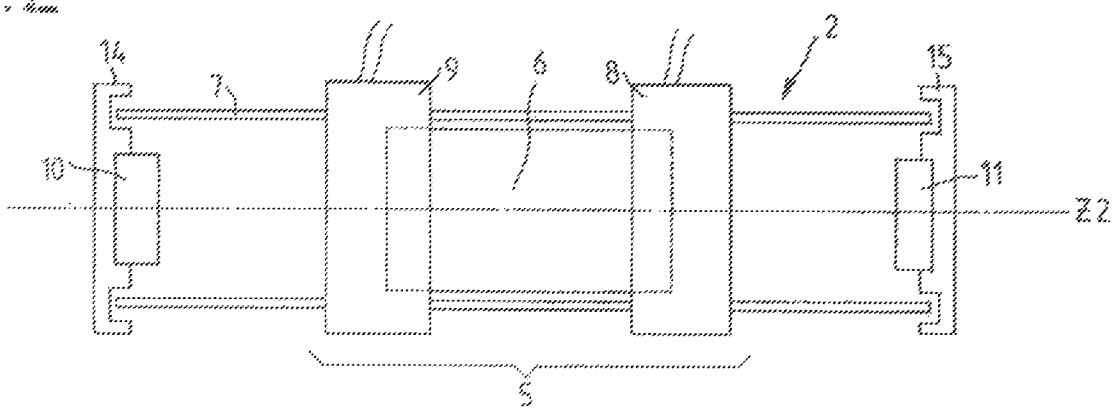
FIG. 2: a schematic cross section of a vibration generator used according to the invention.

Form FIG. 2 can be taken that the means 2 for generating mechanical vibrations include at least one coil element 5, in the exemplary embodiment comprising excitation coils 8, 9 and a movably guided ferromagnetic core 6. Specifically, a cylinder element 7 for example of aluminum is provided, which has a relative magnetic permeability of approximately 1, wherein the core 6 is guided parallelly to a cylinder element axis Z2.

A comparative analysis of FIGS. 1 and 2 shows that the cylinder element axis Z2 extends coaxially with respect to the cylinder axis Z1, wherein alternatively the parallel spaced-apart arrangement of the axes Z1 and Z2 is of course also possible. Thereby, the core moves 6 coaxially guided with respect to the cylinder axis Z1 and in the cylinder element 7. From FIG. 1 can further be taken that a control component 12 configured as a rotary button is arranged at one end of the housing 1, by means of which the frequency and/or stroke of the mechanical vibrations of the core 6 are adjustable and controllable. Further, an on/off switch 13 is provided.

It is understood in the context of the invention that the cylinder element 7 is preferably rigidly connected to the housing 1. Thereby, the mechanical vibration of the core 6 is transmitted in an optimum way to the housing 1 as a whole.

Returning to FIG. 2, it can be seen that two mutually coaxial excitation coils 8, 9 spaced-apart in the direction of the cylinder element axis Z2 are provided. Furthermore, end magnets 10, 11 are visible being arranged on the inside and on each end of the cylinder element 7. In the case of a magnetized core 6 the two excitation coils 8, 9 are driven alternately and with opposite polarity by the electronic means 3. The end magnets 10, 11 consist, for example, of ferrite.

A inventive massaging according to the invention device typically has a core 6 with a mass m1, which is in the range from 10 to 300 g, in particular 15 to 200 g, preferably 20 to 80 g. The total mass m2 of the massaging device is typically in the range from 100 to 1,000 g, in particular from 150 to 500 g, preferably from 200 to 400 g. The electronic means 3 control the means 2 for generating mechanical vibrations at a frequency typically in the range from 0.3 to 5 Hz. In this case, typically the control is effected by the excitation coils 8, 9 with a rectangular function or a trapezoidal function of high slope. Thereby, high accelerations of the core 6 and corresponding counter-movements of the housing 1 are induced. The stroke H of the core 6 in directions parallel to the cylinder axis Z2 is typically in the range from 5 to 150 mm. The stroke H of the vibrating core 6 corresponds to the distance of the mutually facing surfaces of the end magnets 10, 11 less the longitudinal extension of the core 6 in the direction of the cylinder element axis Z2. Preferably, the stroke is in the range from 20 to 80 mm.

In the embodiment, the end magnets 10, 11 are mounted in end pieces 14, 15 and fixed therein. The end pieces 14, in turn are connected to the cylinder element 7 or plugged thereonto. Mounting and positioning of the end pieces 14, 15 may, however, alternatively also be carried out by an additional outer housing, which receives the cylinder element 7 and the end pieces 14, 15 and fixes or positions them relative to each other.

In an experimental version of a means 2 for generating mechanical vibrations according to the invention, the two coils 8, 9 are mounted displaceably along the cylinder element axis Z2 and can be fixed in different positions, in the simplest case by that the static friction between the coils 8, 9 and the cylinder element 7 is sufficiently large, so that during operation the coils 8, 9 cannot move by themselves. With such an experimental version, the positions of the coils 8, 9 along the cylinder element axis Z2 being optimum for the respective purpose can easily be determined. These positions will depend, inter alia, on the magnetic materials used, the length and weight of the core 6, the total length of the cylinder element 7 and the desired frequency range, can, however, easily be adjusted and determined. After determination, in series production, the coils are then mounted at the determined positions and are firmly secured.

Figure 3:
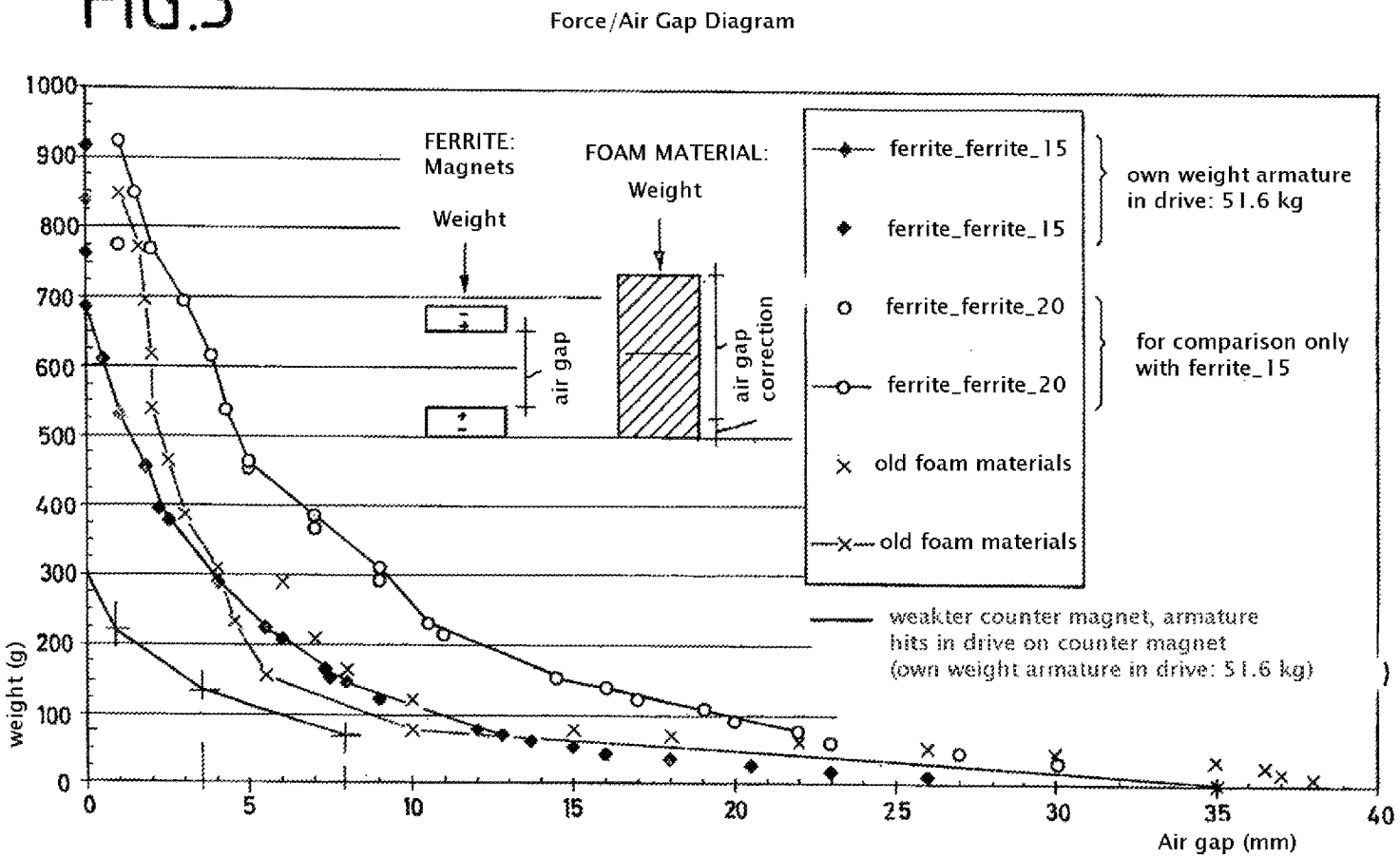
FIG. 3: a force/air gap diagram for various types of impact elements.

In FIG. 3 is shown the remaining air gap or the width thereof as a function of the applied force. For this purpose, a cylinder element 7 with an inserted end magnet 10 was placed vertically with the end magnet 10 showing downward. A core 6 was introduced, and different weights were applied thereto. The distance between the end magnet 10 and the core 6 was measured in each case in dependence on the applied weight. The own weight of the core 6 was 51.6 g. The results for two different ferrite materials as end magnets 10 are shown. In addition, an experiment is shown, wherein the end magnet 10 was replaced by an impact element made of foam material, and a correction was performed by subtracting the thickness of said impact element at maximum compression (corresponding to a "gap width" of 0). It can clearly be seen in the diagram that the different ferrite materials have, with respect to the foam material, a much lower slope of the function, in particular for small air gap values, i.e. "bouncing" occurs considerably softer than in the case of the foam material, with nevertheless comparable weight values without hitting on the end magnet 10 or the foam material.

Figure 4:
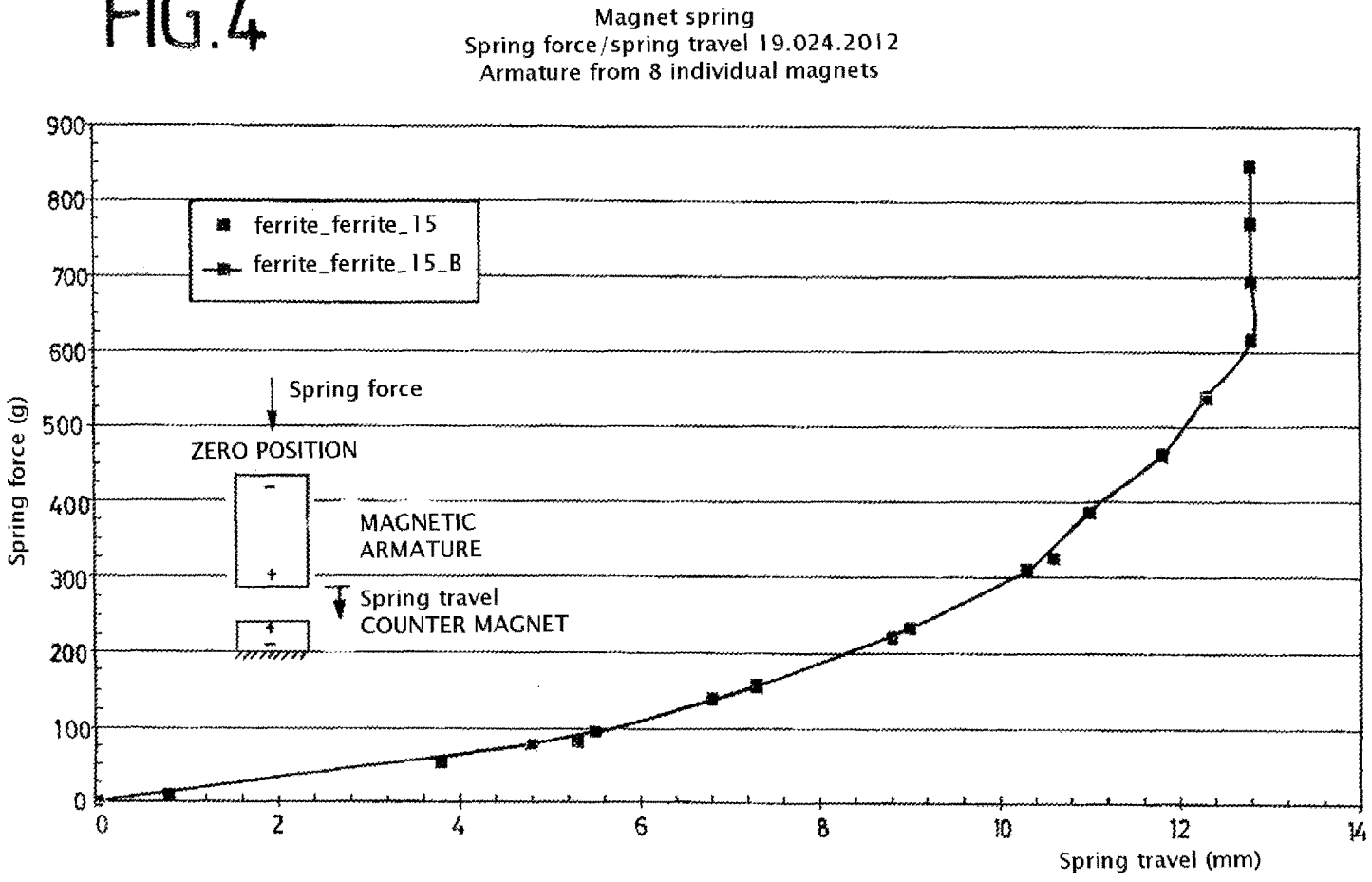
FIG. 4: a spring force/spring travel diagram for a ferritic end magnet.

FIG. 4 shows a spring diagram obtained with the structure, on which FIG. 3 is based. It is apparent that the behavior is non-linear, namely progressive.

In principle, the components of a device according to the invention can be designed such that the vibrations of the core are substantially harmonic vibrations or also clearly non-harmonic vibrations. This is controlled by the exact arrangement of the coils 8, 9 and their electrical activation (duty cycle, pulse shape, etc.). In the embodiment, it is not shown in detail that the end magnets 10, 11 may have, for example, openings or holes for the purpose of air exchange. Reference is made to the general part of the description.

The invention claimed is:

1. A massaging device comprising:

electromechanical means, for generating mechanical vibrations, disposed in a housing, the electromechanical means for generating mechanical vibrations including a cylinder element, in which a core is guided parallelly to a cylinder element axis (Z2), in particular coaxially with respect to the cylinder element axis (Z2), at least one coil element, the coil axis (Z3) of which is arranged coaxially with respect to the cylinder element, and which encloses the cylinder element, and one impact element arranged at each end of the cylinder element and in the interior thereof or at the ends thereof, electronic means, for controlling the electromechanical means for generating mechanical vibrations, disposed in the housing, a power source, which is connected to the electromechanical means for generating mechanical vibrations as well as to the electronic means, and a control component for adjusting the frequency of the mechanical vibrations of the core, wherein the frequency is adjustable and controllable in steps or continuously, wherein the impact elements are formed as end magnets, and wherein the ends of the end magnets respectively facing the ends of the core have a magnetic polarity which is identical to the polarity of the respectively facing ends of the core.

2. The massaging device according to claim 1, wherein magnetic field strengths of the core and of the end magnets are selected and arranged with respect to each other with the proviso that with vertical arrangement and without exposure to artificial external magnetic fields, there remains, with an additional application of a load on the core with 2 to 30 times, preferably 4 up to 24 times, in particular 6 to 18 times its own weight, still a minimum distance between the core and end magnets.

3. The massaging device according to claim 1, wherein air spaces between core and end magnets either communicate with each other or are connected with the air space outside the cylinder element and/or the housing.

4. The massaging device according to claim 3, wherein the connection of the air spaces between core and end magnets is provided by means of a longitudinal bore through the core, an external core groove extending over the total length of the core, a cylinder groove extending on the inner side of the cylinder element at least over the entire range of movement of the core, and/or a gap of at least 0.1 mm between the lateral surface of the core and the inner surface of the cylinder element.

5. The massaging device according to claim 3, wherein the connection of the air spaces between core and end magnets is formed by means of a tube arranged outside the cylinder element, the two ends of the tube being connected with openings in the cylinder element, which in the region of a respective end magnet lead into the air spaces between core and end magnets.

6. The massaging device according to claim 3, wherein outwardly open openings are provided in the cylinder element, which in the region of a respective end magnet lead into the air spaces between core and end magnets.

7. The massaging device according to claim 3, the cylinder element includes at its ends end pieces closing the cylinder element, which end pieces carry or enclose the end magnets, the end pieces having openings, which connect the interior of the cylinder element to the outside of the cylinder element, and preferably extend substantially parallelly to the cylinder axis of the cylinder element, and/or are disposed close to the periphery of the end pieces, and that the openings outside the end pieces are optionally connected to each other by a housing enclosing the means for generating mechanical vibrations or by at least one tube.

8. The massaging device according to claim 1, wherein the cylinder element is formed of a metallic material having a permeability of less than 1, in particular aluminum.

9. The massaging device according to claim 1, wherein the inner wall of the cylinder element in the cross section orthogonal to the cylinder axis Z2 is circular and the core has a cylindrical shape preferably with a radius, which is by 0.01 to 1.5 mm, in particular by 0.01 to 0.5 mm smaller than the cross-sectional inner radius of the cylinder element.

10. The massaging device according to claim 1, wherein the core has a mass m1, with the mass ratio m1:m2 relative to the total mass m2 of the massaging device being in the range from 1:100 to 1:3, preferably from 1:50 to 1:3, in particular from 1:20 to 1:3, most preferably 1:10 to 1:3.

11. The massaging device according to claim 1, wherein the mass m1 is in the range from 10 to 300 g, preferably from 15 to 200 g, most preferably 20 to 80 g.

12. The massaging device according to claim 1, wherein the stroke of the core in directions parallel to the cylinder element axis (Z2) is in the range from 5 to 150 mm, preferably from 10 to 100 mm, most preferably from 10 to 60 mm.

13. The massaging device according to claim 1, wherein the electronic means control the means for generating mechanical vibrations with a frequency in the range from 0.1 to 50 Hz, preferably from 0.1 to 20 Hz, most preferably from 0.3 to 10 Hz, in particular from 0.3 to 5 or 10 Hz.

14. The massaging device according to claim 1, wherein two mutually coaxial excitation coils spaced-apart in the direction of the cylinder element axis (Z2) are provided.

15. The massaging device according to claim 1, wherein the housing has an outer wall formed of a physiologically acceptable material.

16. The massaging device according to claim 1, wherein by the electronic means, electric energy is applied to the excitation coils having pulse durations in the range from 5 to 100 ms, preferably from 10 to 60 ms, in particular from 20 to 40 ms, the pulse shape preferably being substantially rectangular, trapezoidal, or sinusoidal.

17. The massaging device according to claim 1, wherein by the electronic means, electric energy is not applied to the excitation coils for a period of time in the range from 5 to 800 ms, preferably 7 to 600 ms, in particular 10 to 300 ms, wherein these data respectively relate in particular to a power stage selected by a user.

18. The massaging device according to claim 1, wherein differences of the times, in which electric energy is not applied to the excitation coils by the electronic means, are in the ranges from 10 to 800 ms, preferably 15 to 600 ms, in particular 20 to 40 ms, wherein these data respectively relate in particular to a power stage selected by a user.

19. The massaging device according to claim 1, wherein periods of time, in which electric energy is not applied to the excitation coils by the electronic means, differ among each other by 2 to 100 times, preferably by 3 to 80 times, in particular by 4 to 60 times, wherein these data respectively relate in particular to a power stage selected by a user.

20. The massaging device according to claim 1, wherein an inner wall of the cylinder element and/or an outer wall of the core has a slide lubricious coating.

21. A device for generating vibrations on an object, in particular a stroller, a crib or other lying surface for a person, comprising:

electromechanical means for generating mechanical vibrations, disposed in a housing, the electromechanical means for generating mechanical vibrations including a cylinder element, in which a core is guided parallelly to a cylinder element axis (Z2), in particular coaxially with respect to the cylinder element axis (Z2), at least one coil element, the coil axis (Z3) of which is arranged coaxially with respect to the cylinder element, and which encloses the cylinder element, and one impact element each, which is arranged at each end of the cylinder element and in the interior thereof, electronic means for controlling the electromechanical means for generating mechanical vibrations, disposed in the housing, and an energy source, which is connected to the means for generating mechanical vibrations as well as to the electronic means, wherein the device is securable to the object by means of at least one fastening element, wherein the impact elements are formed as end magnets, wherein the ends of the end magnets respectively facing the ends of the core have a magnetic polarity, which is identical to the polarity of the respectively facing ends of the core, and wherein the frequency of the mechanical vibrations of the core is adjustable and controllable in steps or continuously.

* * * * *